United States Patent [19]

Jurca

[11] 4,266,500

[45] May 12, 1981

[54] HOVER CONTROL SYSTEM FOR A SUBMERSIBLE BUOY

[75] Inventor: Joseph A. Jurca, Tarzana, Calif.

[73] Assignee: Bunker Ramo Corporation, Oak Brook, Ill.

[21] Appl. No.: 78,256

[22] Filed: Sep. 24, 1979

[51] Int. Cl.[3] ..... B63G 8/22

[52] U.S. Cl. ..... 114/333; 9/8R

[58] Field of Search ..... 114/330, 331, 333, 125; 9/8 R; 405/205; 73/170 A; 102/14

[56] References Cited

U.S. PATENT DOCUMENTS

| | | | |
|---|---|---|---|
| 3,171,376 | 3/1965 | Sellner et al. | 114/333 |
| 3,179,962 | 4/1965 | Shear et al. | 9/8 R |
| 3,257,672 | 6/1966 | Meyer et al. | 9/8 R |
| 3,436,776 | 4/1969 | Davis | 114/331 |
| 3,818,523 | 6/1974 | Stillman, Jr. | 114/333 |
| 3,946,685 | 3/1976 | Chadbourne et al. | 114/333 |
| 3,952,349 | 4/1976 | Erath et al. | 9/8 R |
| 4,031,581 | 6/1977 | Baugh | 9/8 R |

*Primary Examiner*—Trygve M. Blix
*Assistant Examiner*—Jesús D. Sotelo
*Attorney, Agent, or Firm*—F. M. Arbuckle; A. Freilich

[57] ABSTRACT

A compressed fluid hover control system for a submersible buoy in which the water level in a buoyancy chamber is controlled in accordance with external water pressure and predetermined levels of water in the buoyancy chamber. More specifically, a submersible buoy having a fluid-containing chamber containing a compressed fluid is connected to a buoyancy chamber by a gas inlet valve. A gas exhaust valve connects an upper portion of the buoyancy chamber to the surrounding water and a relief duct connects a lower portion of the buoyancy chamber to the surrounding water. Both the gas inlet and gas exhaust valves are controlled by a valve control circuit which opens and closes the valves in accordance with predetermined criteria related to water levels within the buoyancy chamber and the depth of the buoy as determined by a water pressure transducer. The valve control circuit thus causes the buoy to oscillate between predetermined depth levels, those levels changing as the compressed fluid is expended in order to maximize operating life of the buoy. In the specific embodiment described, four level sensors are utilized in the buoyancy chamber and four predetermined depths are programmed in the valve control circuit.

9 Claims, 3 Drawing Figures

HOVER CONTROL SYSTEM FOR A SUBMERSIBLE BUOY

BACKGROUND OF THE INVENTION

The invention relates to hover control systems for submersible buoys.

Conventional control systems frequently utilize an externally generated signal to transfer a pressurized buoyant fluid from a fluid storage chamber to a buoyancy chamber, the buoyancy chamber containing water to be displaced by the buoyant fluid. These systems are adequate for locating the buoy at a predetermined depth but are not readily adaptable for automatic depth adjustment because of weight changes due to loss of the buoyant fluid. In order to effect an automatic transfer of buoyant fluid to a buoyancy chamber in order to maintain hovering at a predetermined depth, other conventional control systems sense the level of water in the buoyancy chamber and maintain an appropriate level for the depth being desired. These systems typically use analog measuring techniques, or flood the buoyancy chamber with buoyancy fluid for a predetermined time when a predetermined depth is reached. Such systems tend to excessively oscillate about the predetermined depth and thus are wasteful of the buoyancy fluid. The hover control system of the present invention solves the above problems by providing a simplified control system that responds only to predetermined water levels within the buoyancy chamber and depth of the buoy as measured by a water pressure transducer.

SUMMARY OF THE INVENTION

The invention provides a hover control means for submersible buoys having a fluid-containing chamber member for containing a pressurized fluid and a buoyancy chamber member having a bottom portion in fluid communication with a surrounding liquid such as a body of water. A first valve means interconnects the fluid-containing chamber to the buoyancy chamber and a second valve means interconnects an upper portion of the buoyancy chamber to the surrounding liquid. Pressure sensing means for determining liquid pressure external to the buoy is provided; and a level sensing means for determining discrete liquid levels in the buoyancy chamber is also provided. A control means responsive to the pressure sensing means and the level sensing means controls the first and second valves so as to maintain the buoy in a hovering condition.

In a specific embodiment of the invention, four water level sensors are provided in the buoyancy chamber, the first sensor being located just below a water level which would provide neutral buoyancy when the fluid-containing chamber is fully pressurized with a compressed buoyancy fluid. The second sensor is located just above a water level in the buoyancy chamber which would provide neutral buoyancy when the fluid-containing chamber is no longer pressurized with respect to the surrounding body of water. The third and fourth water level sensors are located between the first and second sensors. A valve control circuit controls the first and second valves in accordance with inputs from the four water level sensors and a water pressure transducer. Four predetermined water depths are provided to the valve control circuit, these depths being compared to actual water depth as measured by the pressure transducer. Each of the predetermined depths corresponds to one of the four water level sensors in the buoyancy chamber. The valve control circuit is mechanized so that the buoy will slowly oscillate at depths related to the four predetermined depths.

The valve control circuit is basically a digital device which incorporates a means for comparing discrete water levels within the buoyancy chamber and the actual buoy depth with respect to the four predetermined depths. The first and second valves are opened and closed in accordance with this comparison. This simplified approach for the valve control circuit allows implementation with a minimal amount of electronic circuitry, thereby resulting in low cost, ruggedness, long operating life, and a long shelf life. The average compressed fluid consumption for each hover cycle between two of the predetermined depths, and the average hover cycle time is greatly reduced with respect to conventional systems when the third and fourth water level sensors are located much closer together than are the first and second water level sensors associated with the neutral buoyancy levels. In addition, the lower compressed fluid consumption results in a smaller acoustic signature than that associated with conventional hover control systems.

DETAILED DESCRIPTION

A detailed illustrative embodiment of the invention disclosed herein exemplifies the invention and is currently considered to be the best embodiment for such purposes. However, it is to be recognized that other means for altering the buoyancy of the buoy in accordance with discrete water levels in a buoyancy chamber and predetermined buoy depths could be utilized. Accordingly, the specific embodiment disclosed is only representative in providing a basis for the claims which define the scope of the present invention.

As previously explained, the invention provides a hover control system for a submersible buoy in which various water levels within a buoyancy chamber and the water pressure surrounding the buoy are used to alter its buoyancy as water in the buoyancy chamber is cycled within predetermined limits. Although the exemplary embodiment is described in terms of a buoy submersed in water, the hover control system could be utilized in conjunction with other liquids such as oil or the like.

Figure 1:
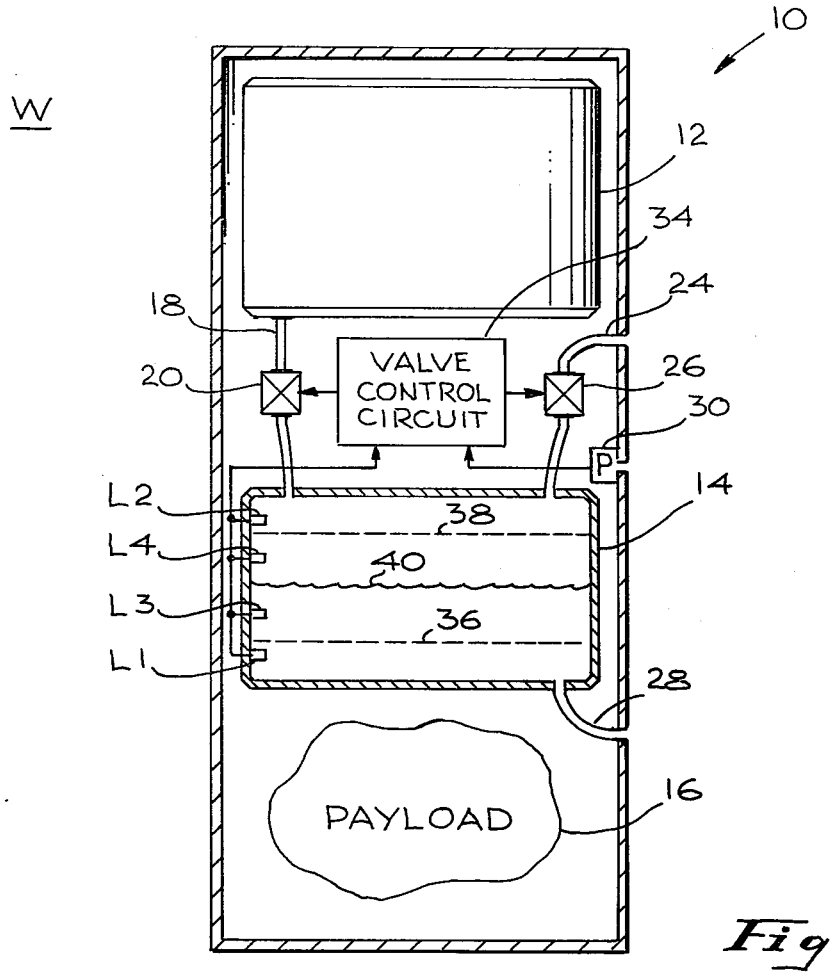
FIG. 1 is a diagrammatic view of a submersible buoy provided by the invention.

Referring to FIG. 1, a submersible buoy 10 is shown having a compressed fluid-containing chamber 12, a buoyancy chamber 14 and a payload section 16 which could contain sound detection equipment, explosives, or the like. The compressed fluid chamber 12 is connected to the buoyancy chamber 14 by a gas inlet duct 18. Flow of the compressed fluid, which could be gaseous in form, through the gas inlet duct 18 is regulated by a gas inlet valve 20. A gas exhaust duct 24 connects an upper portion of the buoyancy chamber 14 to the surrounding water W. Flow through the gas exhaust duct 24 is controlled by a gas exhaust valve 26. A relief duct 28 connects a bottom portion of the buoyancy chamber 14 to the surrounding water. A pressure transducer 30 provides a signal related to the surrounding water pressure to a valve control circuit 34 whose operation will be explained in further detail below. In addition, there are four water-level sensors located in the buoyancy chamber 14. The sensors are designated as a first level sensor L1, a second level L2, a third level sensor L3 and a fourth sensor L4. These sensors are of the type that provides one output voltage when the water level in the buoyancy chamber 14 is above an associated predetermined level, and another voltage when the water level is below the predetermined level.

The various components of the submersible buoy 10 are located so as to keep the centers of mass, buoyancy, and vertical drag on the vertical axis of the buoy 10, and the center of buoyancy always above the center of mass. The four level sensors L1–L4 can be of any suitable type, examples of which include seawater switches or float actuated microswitches. The first water level sensor L1 is vertically located just below a water level within the buoyancy chamber 14 which will result in a neutral buoyancy when the fluid chamber 12 is completely charged with compressed fluid. This neutral buoyancy level is shown as a dotted line 36. The second water level sensor L2 is vertically located just above a water level within the buoyancy chamber 14 which will result in a neutral buoyancy when the fluid chamber 12 is no longer pressurized with respect to the pressure of the surrounding water. This neutral buoyancy is shown as a dotted line 38. The location of the water level switches L1 and L2 in the above manner will compensate for the buoy's loss of mass as compressed fluid is expended, and assures control system stability. The other two level sensors L3 and L4 are located between the first two level sensors L1 and L2. Each of the water level sensors L1–L4 is associated with a predetermined reference depth. These four reference depths are set into the valve control circuit 34 and, in a manner to be explained below, are utilized in conjunction with output signals from the water level sensors L1–L4 within the buoyancy chamber 14 to control the hover depth of the submersible buoy. Thus, a reference depth D1 is associated with the first sensor L1, D2 with L2, D3 with L3, and D4 with L4. The two depths D3 and D4 are chosen to bracket a desired depth DD. The reference depths may be offset from each other by fixed depth increments or fixed percentages of the desired depth DD, or by any other scheme so long as D1>D3>DD>D4>D2> and the depth increment between D2 and D1 is less than a desired peak-to-peak depth keeping tolerance. By means of the valve control circuit 34 to be explained below, high pressure fluid from the compressed fluid-containing chamber 12 is admitted to the buoyancy chamber 14 through the gas inlet valve 20 when a buoyancy increase is desired. This fluid displaces water from the buoyancy chamber 14 which passes out through the relief duct 28, thereby causing the buoy to rise.

As previously explained, the valve control circuit 34 has four predetermined reference depths D1–D4 set in prior to deployment of the buoy. The water pressure transducer 30 provides another input to the valve control circuit 34 so that the actual pressure surrounding the buoy can be continually compared to the four predetermined reference depths or pressure D1–D4. The four water level sensors L1–L4 are also connected to the valve control circuit 34 so that four specific water levels within the buoyancy chamber can be ascertained. The valve control circuit 34 is chosen to control the gas inlet valve 20 and the gas exhaust valve 24 in accordance with five predetermined control states. These five control states are:

(1) If the actual buoy depth is greater than the first predetermined depth D1, and the buoyancy chamber water level as shown at 40 is above L1, open the gas inlet valve 20 (increase buoyancy).

(2) If the actual buoy depth is greater than the third predetermined depth D3 and the buoyancy chamber water level is above L3, open the gas inlet valve 20 (increase buoyancy).

(3) If the actual buoy depth is less than the second predetermined depth D2 and the buoyancy chamber water level is below L2, open the gas exhaust valve 26 (decrease buoyancy).

(4) If the actual buoy depth is less than the fourth predetermined depth D4 and the buoyancy chamber water level is below L4, open the gas exhaust valve 26 (decrease buoyancy).

(5) If none of the test conditions in control states 1 through 4 are satisfied, close both the gas inlet valve 20 and the gas exhaust valve 26.

Figure 2:
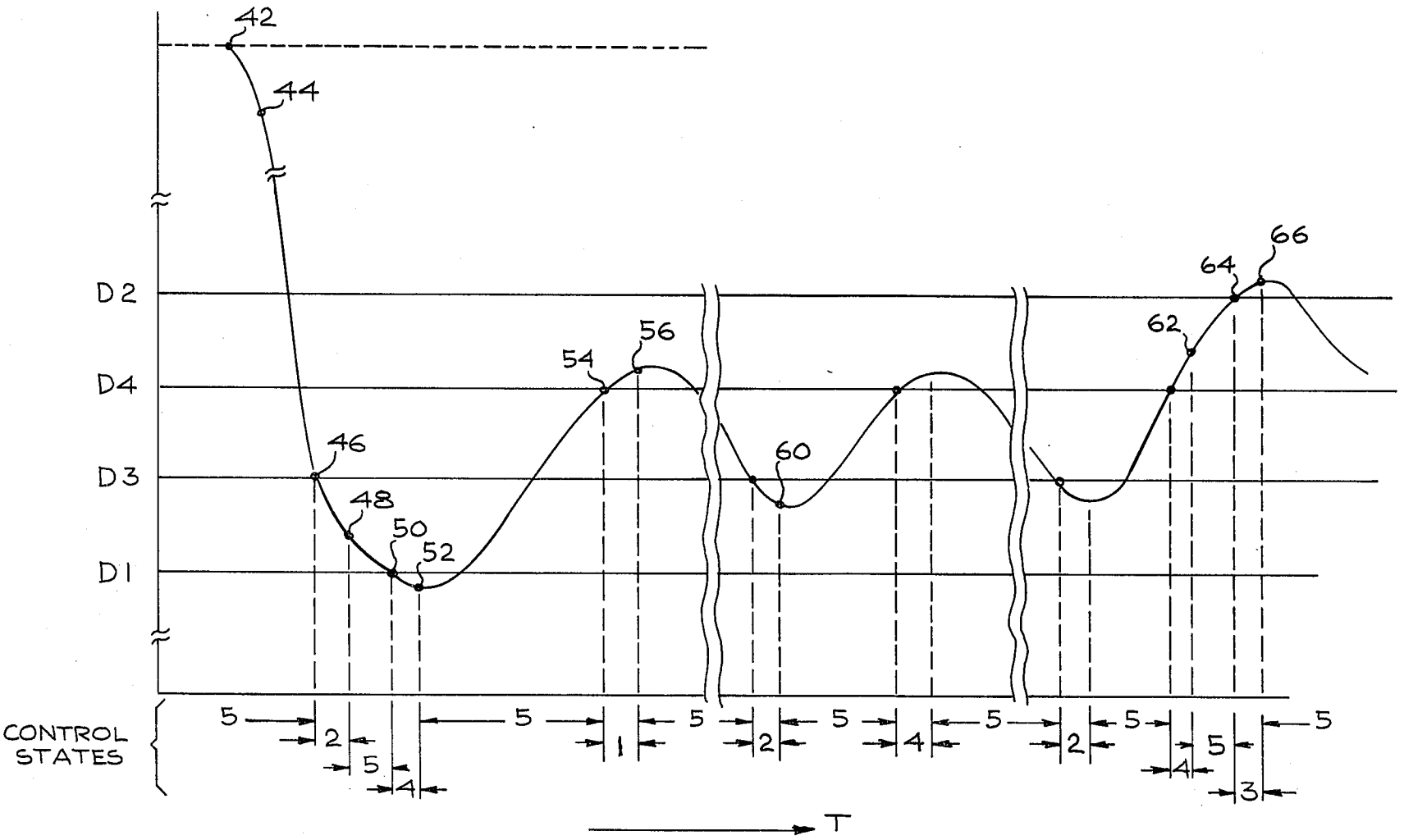
FIG. 2 is a depth vs. time profile of a submersible buoy operating in a manner provided by the invention.

Operation of the buoy in accordance with the five control states previously explained can be understood by reference to FIG. 2. The four predetermined reference depths D1, D2, D3 and D4 can be seen. The figure shows typical depth versus time profiles which illustrate operation of the valve control circuit 34 as a function of buoy depth and loss of compressed fluid. Assuming the buoy 10 is launched near the water surface at 42 with the buoyancy chamber 14 full of water, it begins to sink and soon achieves a terminal velocity shown at 44 which is related to its drag coefficient and the negative buoyancy inherent in its structure. The buoy continues to sink at a constant rate until it reaches the third predetermined depth D3 shown at 46. At this point, the second control state is activated because the buoy depth is now below the third predetermined depth D3 and water in the buoyancy chamber 14 is above the third water level sensor L3. At this point, gas flowing from the fluid-containing chamber 12 to the buoyancy chamber 14 forces water in the buoyancy chamber 14 out the relief duct 28 until its level is below the third water level sensor L3. When the water is below the third water level sensor L3, as shown at 48, the fifth control state is implemented, thus closing the gas inlet duct 20. The buoy 10 now has an increased buoyancy which results in a lower vertical velocity. Since none of the compressed fluid has yet been lost to the surrounding body of water, the new water level in the buoyancy chamber 14 does not result in a positive buoyancy, and the buoy depth continues to increase at a slower velocity until the first predetermined depth D1 is reached, as shown at 50. When the buoy 10 is below the first predetermined level D1, the first control state is activated and the gas inlet valve 20 is again opened until the buoyancy chamber water level is forced below the first level sensor L1. As previously explained, since L1 is below the neutral buoyancy water line 36 when the fluid chamber 12 is full of compressed fluid, a slight positive buoyancy is developed and the buoy 10 begins to rise. When the buoyancy chamber water level reaches L1 as shown at 52, the fifth control state is again activated and the gas inlet valve 20 is closed. The buoy 10 continues to slowly rise until it reaches the fourth predetermined depth D4 as shown at point 54. At this point the fourth control state is activated because the buoy is at a depth less than that of the fourth predetermined depth D4 and the water level is below the fourth water level sensor L4. At this point, the gas exhaust valve 26 is opened and the buoyancy fluid passes from the buoyancy chamber 14 to the surrounding water until the water level within the buoyancy chamber 14 rises to that of the fourth water level sensor L4. This new water level results in the buoy again having a negative buoyancy as shown at 56 and the buoy 10 slowly begins to descend. This cycle then repeats itself with the buoy oscillating with a nominal overshoot and undershoot between the first and fourth predetermined depths D1 and D4.

During each of the above-described oscillation cycles the buoy 10 loses an increment of compressed fluid, thus reducing its total mass. However, the oscillations continue until enough of the compressed fluid has been lost so that a buoyancy chamber water level at the third level sensor L3 no longer results in a negative buoyancy, but rather in a positive buoyancy as indicated at point 60. This results in a second oscillation phase in which the buoy 10 oscillates between the third and fourth predetermined depths D3 and D4. This second oscillation phase may be accompanied by a greatly reduced compressed fluid consumption per oscillation cycle if the third and fourth water level sensors L3 and L4 are closer to each other than to the first and second water level sensors L1 and L2, respectively. Oscillation between the third and fourth predetermined depths D3 and D4 will continue until sufficient compressed fluid is lost so that a buoyancy chamber water level at the fourth water level sensor L4 no longer results in a negative buoyancy, but rather in a positive buoyancy as indicated at point 62. This results in a third oscillation phase in which the buoy 10 continues upwardly until it reaches the second predetermined depth D2 and the third control state is activated. The gas exhaust valve 26 is then opened as shown at 64 and remains open until the buoyancy chamber water level reaches the second water level sensor L2 as shown at 66. This cycle continues with the buoy oscillating between the second and third predetermined depths until the buoy is out of compressed fluid.

Figure 3:
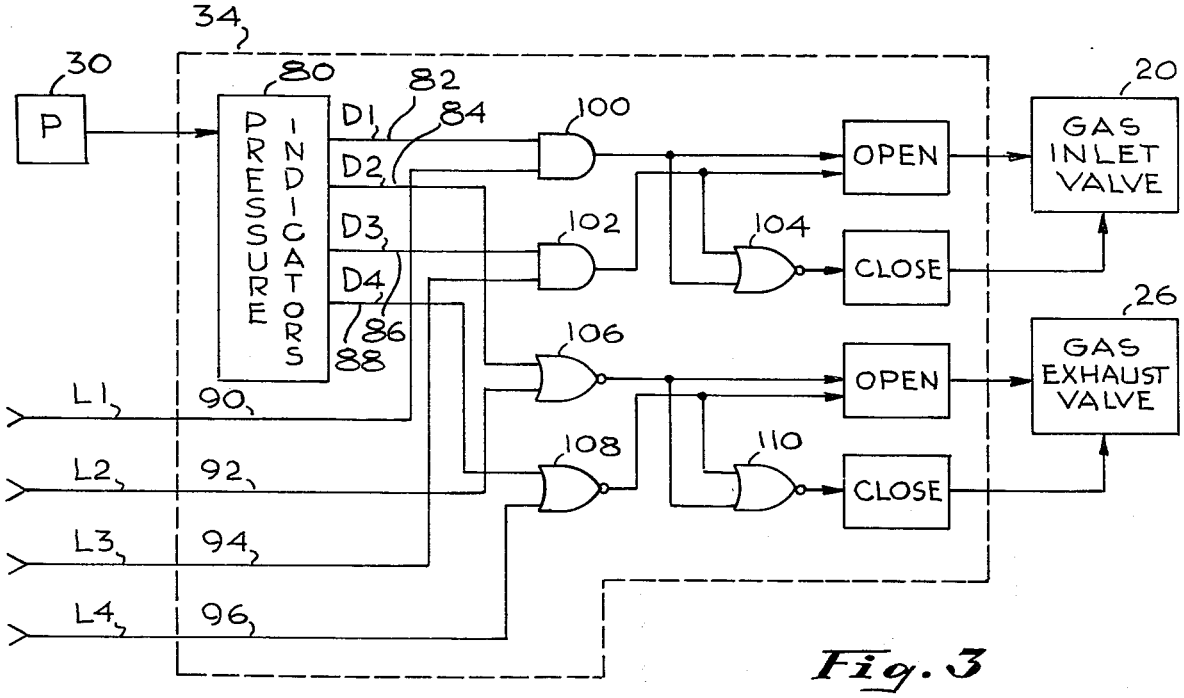
FIG. 3 is a block and logic diagram of the valve control circuit.

Referring now to FIG. 3, logic in the valve control circuit 34 for implementing the five predetermined control states can be seen. Signals corresponding to the predetermined reference depths or pressures D1–D4 are provided by a pressure indicator unit 80. The signal 82 corresponding to reference depth D1 goes from a low state to a high state whenever the actual buoy depth as measured by the pressure transducer 30 exceeds the first predetermined depth D1. Similarly, signals 84, 86 and 88 also go from a low state to a high state whenever the actual buoy depth exceeds the second, third and fourth predetermined depths D2, D3 and D4, respectively. The four level sensors L1–L4 are also chosen to provide output signals 90, 92, 94 and 96, respectively, that go from a low state to a high state whenever the water level in the buoyancy chamber 14 exceeds the level being monitored by its associated level sensor. A first AND gate 100 provides a high output signal to open the gas inlet valve 20 when D1 and L1, signals 82 and 90, respectively, are high; and a second AND gate 102 provides a high output signal to open the gas inlet valve when D3 and L3 are high. A NOR gate 104 provides a high signal to close the gas inlet valve when neither output signal from the two AND gates 100 and 102 are high. Two additional NOR gates 106 and 108 and NOR gate 110 are used to similarly control the gas exhaust valve 26.

Although the above description and accompanying figures utilize four predetermined reference depths and four water level sensors, it should be clear that the concept can be applied to larger or smaller numbers of reference depth/level sensor pairs. However, it is important that regardless of the number of depth/sensor pairs utilized, the upper-most water level sensor should be above the neutral buoyancy line 38 when the compressed fluid-containing chamber is empty, and the lower-most water level sensor should be below the neutral buoyancy line 36 when the fluid-containing chamber is full.

It should now be apparent that a hover control system for a submersible buoy has been described in which the depth of the buoy is continually adjusted in response to water pressure external to the buoy and to discrete water levels within a self-contained buoyancy chamber. In the embodiment described, four water level sensors and four predetermined depths are utilized, the buoy alternating between various of the predetermined depths as the compressed fluid is depleted.

What is claimed is:

1. A submersible buoy having a hover control means comprising:

a fluid-containing chamber member for containing a pressurized fluid;

a buoyancy chamber member having a bottom portion in fluid communication with a surrounding liquid;

a first valve means interconnecting said fluid-containing chamber and said buoyancy chamber;

a second valve means interconnecting an upper portion of said buoyancy chamber and said surrounding liquid;

pressure sensing means for determining liquid pressure external to said buoy;

level sensing means for determining discrete liquid levels in said buoyancy chamber; and control means responsive to said pressure sensing means and said level sensing means for controlling said first and second valves, thereby maintaining said buoy in a hovering state in said surrounding liquid.

2. The control means of claim 1 wherein said level sensing means comprises:

a first liquid level sensor located below a liquid level in said buoyancy chamber which would provide neutral buoyancy for said buoy when said fluid chamber is fully pressurized with a compressed fluid;

a second liquid level sensor located above a liquid level in said buoyancy chamber which would provide neutral buoyancy for said buoy when said fluid chamber is no longer pressured with respect to the pressure of said surrounding liquid;

said control means comprises means to open said first valve when said surrounding liquid pressure is greater than a first predetermined pressure D1 and the liquid level in said buoyancy chamber is above said first liquid level, and to open said second valve when said surrounding liquid pressure is less than a second predetermined pressure D2 and the liquid level in said buoyancy chamber is below said second liquid level.

3. The control means of claim 2 further comprising:

a third liquid level sensor located between said first and second liquid level sensors;

a fourth liquid level sensor located between said third and second liquid level sensors, and said control means further comprises means to open said first valve when said surrounding liquid pressure is greater than a third predetermined pressure D3 and the liquid level in said buoyancy chamber is above said third liquid level, and to open said second valve when surrounding liquid pressure is less than a fourth predetermined pressure D4 and the liquid level in said buoyancy chamber is below said fourth liquid level.

4. A buoyancy control system for a buoy to be submersed in a surrounding liquid comprising:

a first chamber for containing a pressurized fluid;

a second chamber having an opening formed in its bottom to permit liquid to flow between said second chamber and said surrounding liquid;

controllable interconnection means for interconnecting said first chamber and said second chamber;

controllable pressure relief means for opening an upper portion of said second chamber to said surrounding liquid; and depth adjustment means responsive to liquid pressure external to said buoy and to liquid levels within said second chamber for controlling said interconnection means and said pressure relief means.

5. The control system of claim 4 wherein said interconnection means comprises a first valve and said pressure relief means comprises a second valve, said control system further comprises:

a pressure sensor for determining liquid pressure external to said buoy; and at least two liquid level sensors for measuring liquid levels within said second chamber.

6. The buoyancy control system of claim 5 wherein said at least two liquid level sensors comprises four liquid level sensors comprising:

a first sensor for determining when said liquid level is below a first predetermined liquid level in said second chamber, said first liquid level being lower than a liquid level in said second chamber which would provide neutral buoyancy for said buoy when said first chamber is fully pressurized with said fluid;

a second sensor for determining when said liquid level is above a second predetermined liquid level in said second chamber, said second liquid level being higher than a liquid level in said second chamber which would provide neutral buoyancy for said buoy when said first chamber is not pressurized with respect to said surrounding liquid pressure;

a third sensor for determining when said liquid level is above a third predetermined liquid level in said second chamber, said third liquid level being between said first and second liquid levels; and a fourth sensor for determining when said liquid level is below a fourth predetermined liquid level in said second chamber, said fourth liquid level being between said third and second liquid levels.

7. The buoyancy control system of claim 6 wherein said depth adjustment means comprises:

means for opening said first valve when said second chamber liquid level is above said predetermined liquid level and said liquid pressure external to said buoy is greater than a first predetermined pressure;

means for opening said second valve when said second chamber liquid level is below said second predetermined liquid level and said liquid pressure external to said buoy is less than a second predetermined pressure;

means for opening said first valve when said second chamber liquid level is above said third predetermined liquid level and said liquid pressure external to said buoy is greater than a third predetermined pressure; and means for opening said second valve when said second chamber liquid level is below said fourth predetermined liquid level and said liquid pressure external to said buoy is less than a fourth predetermined pressure.

8. A method of controlling the depth of a free buoy suspended in a surrounding liquid comprising the steps of:

placing a pressurized fluid in a first chamber;

interconnecting said first chamber to a second chamber by a controllable first valve, said second chamber having an opening formed in its bottom to permit liquid to flow between said second chamber and said surrounding liquid;

interconnecting an upper portion of said second chamber and said surrounding liquid by a controllable second valve;

controlling said first and second valves by a means responsive to liquid pressure external to said buoy and to liquid levels within said second chamber.

9. The method of claim 8 wherein said controlling step further comprises the steps of:

opening said first valve when said second chamber liquid level is above a first predetermined level and said liquid pressure external to said buoy is greater than a first predetermined pressure;

opening said second valve when said second chamber liquid level is below a second predetermined liquid level higher than said first predetermined liquid level and said liquid pressure external to said buoy is less than a second predetermined pressure;

opening said first valve when said second chamber liquid level is above a third predetermined liquid level higher than said first predetermined liquid level and lower than said second predetermined liquid level, and said liquid pressure external to said buoy is greater than a third predetermined liquid pressure; and opening said second valve when said second chamber liquid level is below a fourth predetermined liquid level higher than said third predetermined liquid level and lower than said second predetermined liquid level, and said liquid pressure external to said buoy is less than a fourth predetermined pressure.

* * * * *